US011769625B2

(12) United States Patent
Chen et al.

(10) Patent No.: US 11,769,625 B2
(45) Date of Patent: Sep. 26, 2023

(54) TRANSFORMER APPARATUS REDUCING MAGNETIC FIELD INTERFERENCE

(71) Applicant: P-DUKE TECHNOLOGY CO., LTD., Taichung (TW)

(72) Inventors: Lien-Hsing Chen, Taichung (TW); Cheng-Te Tsai, Taichung (TW); Sheng-Ken Huang, Taichung (TW)

(73) Assignee: P-DUKE TECHNOLOGY CO., LTD., Taichung (TW)

( * ) Notice: Subject to any disclaimer, the term of this patent is extended or adjusted under 35 U.S.C. 154(b) by 503 days.

(21) Appl. No.: 17/114,550

(22) Filed: Dec. 8, 2020

(65) Prior Publication Data

US 2022/0181075 A1 Jun. 9, 2022

(51) Int. Cl.

| | |
|---|---|
| ***H01F 27/28*** | (2006.01) |
| ***H01F 27/40*** | (2006.01) |
| ***H01B 7/02*** | (2006.01) |
| ***H01F 27/02*** | (2006.01) |
| ***H01F 27/24*** | (2006.01) |

(52) U.S. Cl.

CPC ..... *H01F 27/40* (2013.01); *H01B 7/02* (2013.01); *H01F 27/02* (2013.01); *H01F 27/24* (2013.01); *H01F 27/28* (2013.01)

(58) Field of Classification Search

CPC . H01B 7/02; H01F 5/04; H01F 27/346; H01F 27/00–40

See application file for complete search history.

(56) References Cited

U.S. PATENT DOCUMENTS

2012/0119864 A1* 5/2012 Lint ..... H01F 27/306 29/605
2020/0143971 A1* 5/2020 Sheehan ..... H01F 27/2828

FOREIGN PATENT DOCUMENTS

TW 201837933 A 10/2018
TW M607215 U 2/2021

OTHER PUBLICATIONS

Office Action dated Feb. 4, 2021 of corresponding Taiwan patent application No. 109135341.

* cited by examiner

*Primary Examiner* — Tuyen T Nguyen
(74) *Attorney, Agent, or Firm* — BACON & THOMAS, PLLC

(57) ABSTRACT

A transformer apparatus reducing magnetic field interference includes an iron core, a first side coil unit, a second side coil unit, a first current transmission line, a second current transmission line and a third current transmission line. Both the first side coil unit and the second side coil unit are wound around the iron core. The first side coil unit is connected to the first current transmission line and the second current transmission line. The second current transmission line is connected to the third current transmission line. The first current transmission line includes a first current conduction segment and a first insulation layer. The first insulation layer coats the first current conduction segment. The third current transmission line includes a second current conduction segment and a second insulation layer. The second insulation layer coats the second current conduction segment. The second insulation layer touches the first insulation layer.

10 Claims, 4 Drawing Sheets

TRANSFORMER APPARATUS REDUCING MAGNETIC FIELD INTERFERENCE

BACKGROUND OF THE INVENTION

Field of the Invention

The present invention relates to a transformer apparatus, and especially relates to a transformer apparatus reducing the magnetic field interference.

Description of the Related Art

Transformers are very common. Transformers are electronic circuits that can increase the voltage or decrease the voltage by applying the Faraday's electromagnetic induction law. A transformer usually includes two or more coils. The main purpose is to increase and decrease the voltage of the alternating current power source, change the impedance and act as a separation circuit. Therefore, transformers are very important.

Some electronic products require a relatively high isolation between the primary side and the secondary side of the transformer by regulations, for example, the transformer used in some medical equipment. At this time, the wire length of the coil of the transformer often needs to be elongated to achieve the relatively high isolation between the primary side and the secondary side of the transformer by regulations mentioned above.

However, the disadvantage of the relatively high isolation between the primary side and the secondary side of the transformer by regulations mentioned above is that the magnetic field interference generated by the current of the transformer is large. As a result, problems such as more ripple noises, greater electromagnetic interferences and so on, are generated.

SUMMARY OF THE INVENTION

In order to solve the above-mentioned problems, an object of the present invention is to provide a transformer apparatus reducing the magnetic field interference.

In order to achieve the object of the present invention mentioned above, the transformer apparatus of the present invention includes an iron core, a first side coil unit, a second side coil unit, a first current transmission line, a second current transmission line and a third current transmission line. The first side coil unit is wound around the iron core. The first side coil unit includes a first point and a second point. The second side coil unit is wound around the iron core. The first current transmission line is connected to the first point. The second current transmission line is connected to the second point. The third current transmission line is connected to the second current transmission line. Moreover, the first current transmission line includes a first current conduction segment and a first insulation layer. The first current conduction segment is connected to the first point. The first insulation layer is configured to coat the first current conduction segment. Moreover, the third current transmission line includes a second current conduction segment and a second insulation layer. The second current conduction segment is connected to the second current transmission line. The second insulation layer is configured to coat the second current conduction segment. The second insulation layer is configured to touch the first insulation layer.

Moreover, in an embodiment, the first side coil unit includes a first coil and a second coil. The first coil is wound around the iron core. The first coil includes the first point and a third point. The second coil is wound around the iron core. The second coil includes the second point and a fourth point.

Moreover, in an embodiment, the transformer apparatus further includes a fourth current transmission line, a fifth current transmission line and a sixth current transmission line. The fourth current transmission line is connected to the fourth point. The fifth current transmission line is connected to the third point. The sixth current transmission line is connected to the fifth current transmission line.

Moreover, in an embodiment, the fourth current transmission line includes a third current conduction segment and a third insulation layer. The third current conduction segment is connected to the fourth point. The third insulation layer is configured to coat the third current conduction segment.

Moreover, in an embodiment, the sixth current transmission line includes a fourth current conduction segment and a fourth insulation layer. The fourth current conduction segment is connected to the fifth current transmission line. The fourth insulation layer is configured to coat the fourth current conduction segment. The fourth insulation layer is configured to touch the third insulation layer.

Moreover, in an embodiment, the transformer apparatus further includes an insulation housing, wherein the iron core, the first side coil unit, the second side coil unit, the second current transmission line, the first coil, the second coil and the fifth current transmission line are arranged in the insulation housing.

Moreover, in an embodiment, the transformer apparatus further includes a first electrical connection part and a second electrical connection part. The first electrical connection part is arranged on the insulation housing. The second electrical connection part is arranged on the insulation housing. Moreover, the first current transmission line and the fourth current transmission line are arranged in the insulation housing, and are through the insulation housing to be connected to the first electrical connection part. The third current transmission line and the sixth current transmission line are arranged in the insulation housing, and are through the insulation housing to be connected to the second electrical connection part.

Moreover, in an embodiment, the transformer apparatus further includes a third electrical connection part and a fourth electrical connection part. The third electrical connection part is arranged on the insulation housing, and is electrically connected to the second side coil unit. The fourth electrical connection part is arranged on the insulation housing, and is electrically connected to the second side coil unit.

Moreover, in an embodiment, the first side coil unit is a transformer primary side coil group. The second side coil unit is a transformer secondary side coil group.

Moreover, in an embodiment, the second side coil unit is a transformer primary side coil group. The first side coil unit is a transformer secondary side coil group.

The advantage of the present invention is to reduce the magnetic field interference generated by the current of the current transmission line outside the coil of the transformer.

Please refer to the detailed descriptions and figures of the present invention mentioned below for further understanding the technology, method and effect of the present invention achieving the predetermined purposes. It believes that the purposes, characteristic and features of the present invention can be understood deeply and specifically. However, the figures are only for references and descriptions, but the present invention is not limited by the figures.

DETAILED DESCRIPTION OF THE INVENTION

Figure 1:
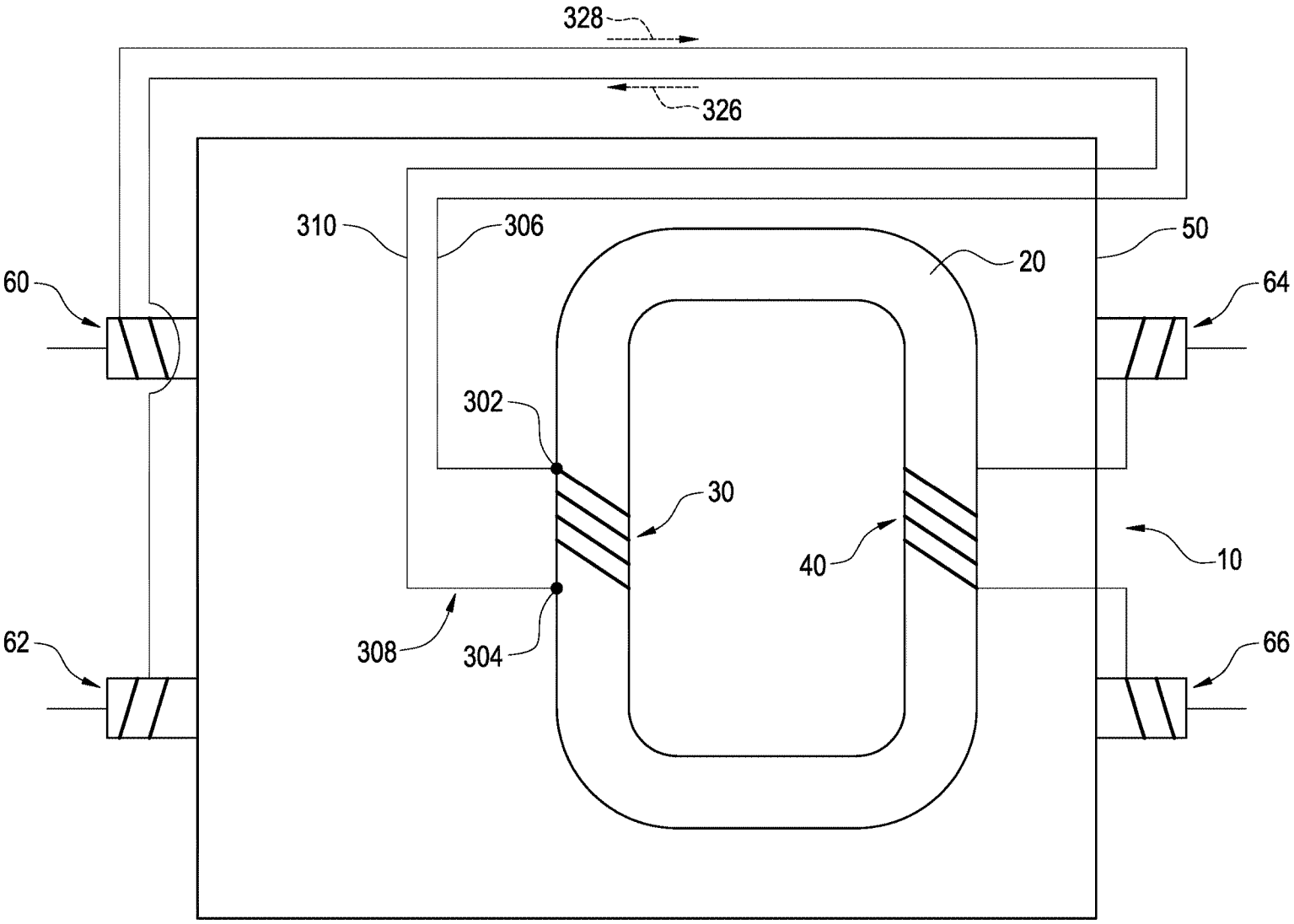
FIG. 1 shows the first embodiment of the transformer apparatus of the present invention.
Figure 2:
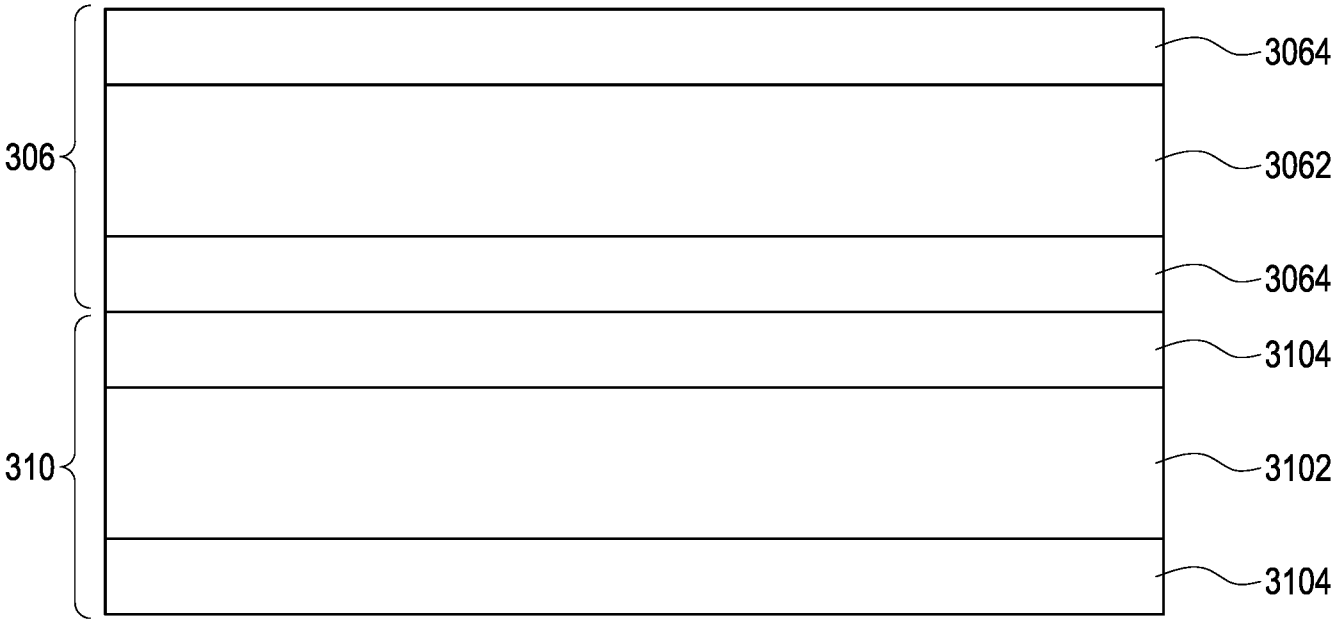
FIG. 2 shows a sectional view of the first current transmission line and the third current transmission line touching each other of the present invention.

In the present disclosure, numerous specific details are provided, to provide a thorough understanding of embodiments of the invention. Persons of ordinary skill in the art will recognize, however, that the present invention can be practiced without one or more of the specific details. In other instances, well-known details are not shown or described to avoid obscuring aspects of the present invention. Now please refer to the figures for the explanation of the technical content and the detailed description of the present invention:

FIG. 1 shows the first embodiment of the transformer apparatus of the present invention. FIG. 2 shows a sectional view of the first current transmission line and the third current transmission line touching each other of the present invention. The transformer apparatus 10 of the present invention reducing a magnetic field interference includes an iron core 20, a first side coil unit 30, a second side coil unit 40, an insulation housing 50, a first electrical connection part 60, a second electrical connection part 62, a third electrical connection part 64, a fourth electrical connection part 66, a first current transmission line 306, a second current transmission line 308 and a third current transmission line 310. The first side coil unit 30 includes a first point 302 and a second point 304. The first current transmission line 306 includes a first current conduction segment 3062 and a first insulation layer 3064. The third current transmission line 310 includes a second current conduction segment 3102 and a second insulation layer 3104. Although FIG. 1 shows a lot of the components, persons of ordinary skill in the art should recognize, however, that the present invention just only requires the iron core 20, the first side coil unit 30, the second side coil unit 40, the first point 302, the second point 304, the first current transmission line 306, the second current transmission line 308, the third current transmission line 310, the first current conduction segment 3062, the first insulation layer 3064, the second current conduction segment 3102 and the second insulation layer 3104 to achieve the effect of the present invention.

Both the first side coil unit 30 and the second side coil unit 40 are wound around the iron core 20. The first current transmission line 306 is connected to the first point 302. The second current transmission line 308 is connected to the second point 304. The third current transmission line 310 is connected to the second current transmission line 308. The first current conduction segment 3062 is connected to the first point 302. The first insulation layer 3064 is configured to coat/cover the first current conduction segment 3062. The second current conduction segment 3102 is connected to the second current transmission line 308. The second insulation layer 3104 is configured to coat/cover the second current conduction segment 3102. The second insulation layer 3104 is configured to touch the first insulation layer 3064. The iron core 20, the first side coil unit 30, the second side coil unit 40 and the second current transmission line 308 are arranged in the insulation housing 50. The first electrical connection part 60, the second electrical connection part 62, the third electrical connection part 64 and the fourth electrical connection part 66 are arranged on the insulation housing 50. The first current transmission line 306 is arranged in the insulation housing 50, and is through the insulation housing 50 to be connected to the first electrical connection part 60. The third current transmission line 310 is arranged in the insulation housing 50, and is through the insulation housing 50 to be connected to the second electrical connection part 62. The third electrical connection part 64 and the fourth electrical connection part 66 are electrically connected to the second side coil unit 40.

Moreover, a shape of the iron core 20 is not limited to FIG. 1. A first turn number of the first side coil unit 30 is not limited to FIG. 1. A first winding direction of the first side coil unit 30 is not limited to FIG. 1. A second turn number of the second side coil unit 40 is not limited to FIG. 1. A second winding direction of the second side coil unit 40 is not limited to FIG. 1. The first current transmission line 306, the first side coil unit 30, the second current transmission line 308 and the third current transmission line 310 are, for example but not limited to, a first same current transmission line, which has a fifth current conduction segment and a fifth insulation layer, wherein the fifth insulation layer is configured to coat/cover the fifth current conduction segment. In order to show the third current transmission line 310 and the first current transmission line 306 clearly, the third current transmission line 310 shown in FIG. 1 does not touch the first current transmission line 306 shown in FIG. 1, but the preferred embodiment of the present invention is that the third current transmission line 310 touches the first current transmission line 306; namely, the second insulation layer 3104 touches the first insulation layer 3064. However, if the third current transmission line 310 does not touch the first current transmission line 306, as long as the third current transmission line 310 is near the first current transmission line 306, the effect of the present invention can still be achieved. The second current transmission line 308, for example but not limited to, does not touch the first current transmission line 306.

Moreover, the second insulation layer 3104 is configured to touch the first insulation layer 3064, so that a first current direction of a first current 326 of the third current transmission line 310 is opposite to a second current direction of a second current 328 of the first current transmission line 306, so that a first magnetic field generated by the first current 326 of the third current transmission line 310 is configured to reduce or countervail a second magnetic field generated by the second current 328 of the first current transmission line 306. A first current path of the second current 328 and the first current 326 is the first electrical connection part 60, the first current transmission line 306, the first point 302, the first side coil unit 30, the second point 304, the second current transmission line 308, the third current transmission line 310 and the second electrical connection part 62. The first electrical connection part 60 and the second electrical connection part 62 are electrically connected to other electronic apparatuses or circuits to receive a first power. The third electrical connection part 64 and the fourth electrical connection part 66 are also electrically connected to other electronic apparatuses or circuits to transmit a second power.

The current flowing through the first side coil unit 30 to generate the magnetic field so that the second side coil unit 40 induces to generate the current is a conventional technology, so it will not be repeated here. The first side coil unit 30 shown in FIG. 1 is a transformer primary side coil group, and the second side coil unit 40 is a transformer secondary side coil group, but the present invention is not limited to it; the second side coil unit 40 is a transformer primary side coil group, and the first side coil unit 30 is a transformer secondary side coil group.

Figure 3:
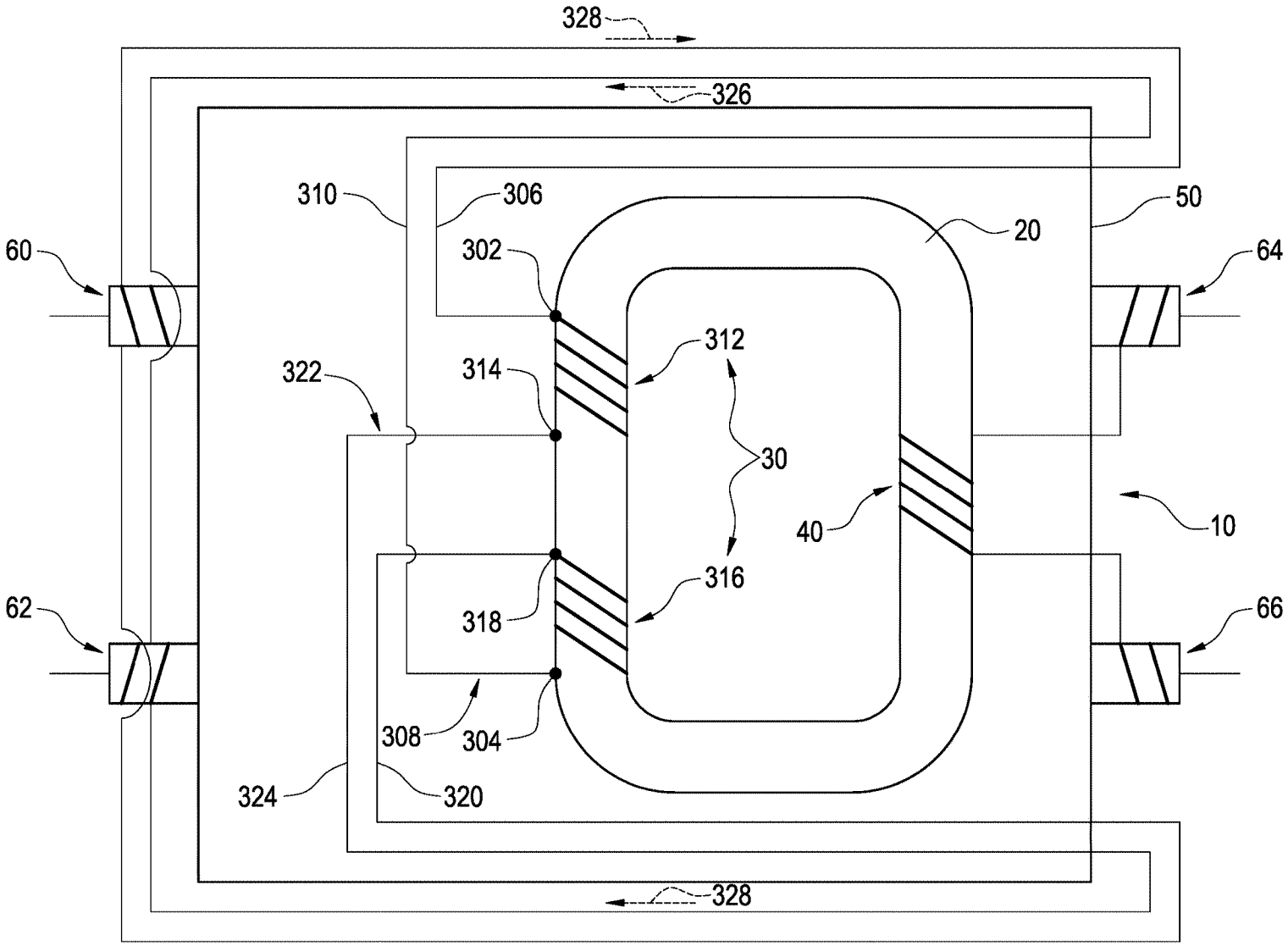
FIG. 3 shows the second embodiment of the transformer apparatus of the present invention.
Figure 4:
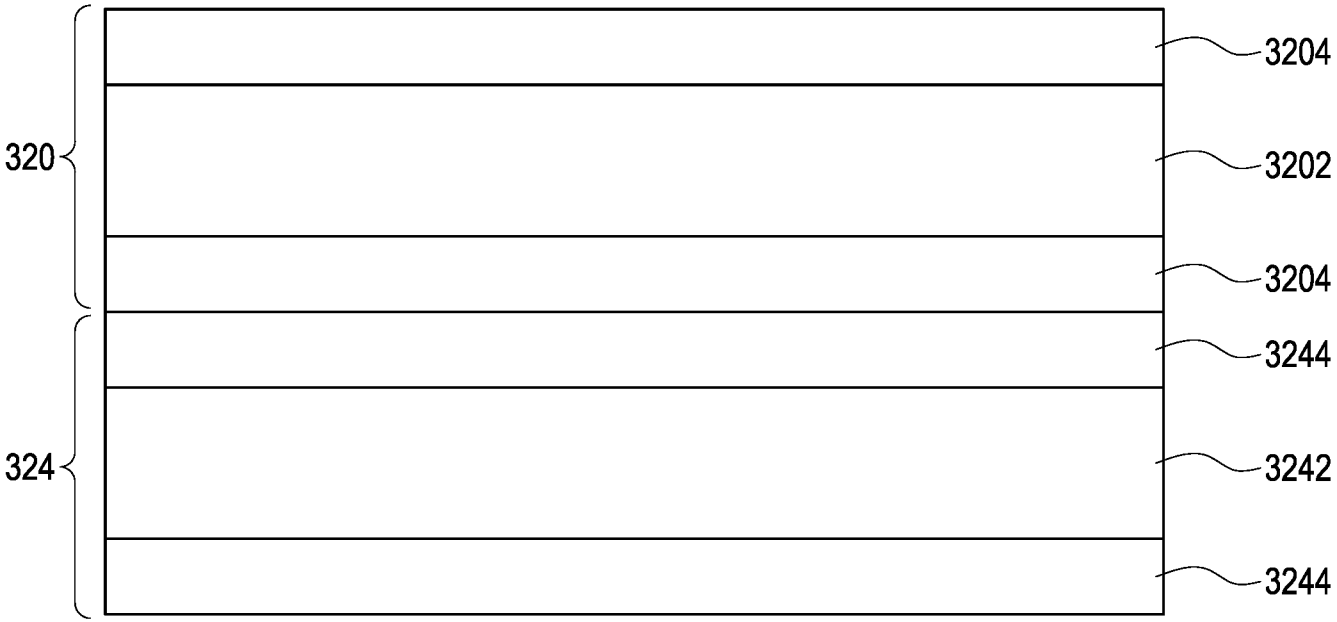
FIG. 4 shows a sectional view of the fourth current transmission line and the sixth current transmission line touching each other of the present invention.

FIG. 3 shows the second embodiment of the transformer apparatus of the present invention. FIG. 4 shows a sectional view of the fourth current transmission line and the sixth current transmission line touching each other of the present invention. The descriptions of the elements shown in FIGS. 3 and 4 which are the same as the elements shown in FIGS. 1 and 2 are not repeated here for brevity. The transformer apparatus 10 further includes a fourth current transmission line 320, a fifth current transmission line 322 and a sixth current transmission line 324. The first side coil unit 30 includes a first coil 312 and a second coil 316. The first coil 312 includes the first point 302 and a third point 314. The second coil 316 includes the second point 304 and a fourth point 318. The fourth current transmission line 320 includes a third current conduction segment 3202 and a third insulation layer 3204. The sixth current transmission line 324 includes a fourth current conduction segment 3242 and a fourth insulation layer 3244.

Both the first coil 312 and the second coil 316 are wound around the iron core 20. The fourth current transmission line 320 is connected to the fourth point 318. The fifth current transmission line 322 is connected to the third point 314. The sixth current transmission line 324 is connected to the fifth current transmission line 322. The third current conduction segment 3202 is connected to the fourth point 318. The third insulation layer 3204 is configured to coat/cover the third current conduction segment 3202. The fourth current conduction segment 3242 is connected to the fifth current transmission line 322. The fourth insulation layer 3244 is configured to coat/cover the fourth current conduction segment 3242. The fourth insulation layer 3244 is configured to touch the third insulation layer 3204. The first coil 312, the second coil 316 and the fifth current transmission line 322 are arranged in the insulation housing 50. The fourth current transmission line 320 is arranged in the insulation housing 50, and is through the insulation housing 50 to be connected to the first electrical connection part 60. The sixth current transmission line 324 is arranged in the insulation housing 50, and is through the insulation housing 50 to be connected to the second electrical connection part 62.

Moreover, a third turn number of the first coil 312 is not limited to FIG. 1. A third winding direction of the first coil 312 is not limited to FIG. 1. A fourth turn number of the second coil 316 is not limited to FIG. 1. A fourth winding direction of the second coil 316 is not limited to FIG. 1. The first current transmission line 306, the first coil 312, the fifth current transmission line 322 and the sixth current transmission line 324 are, for example but not limited to, a second same current transmission line, which has a sixth current conduction segment and a sixth insulation layer, wherein the sixth insulation layer is configured to coat/cover the sixth current conduction segment. The fourth current transmission line 320, the second coil 316, the second current transmission line 308 and the third current transmission line 310 are, for example but not limited to, a third same current transmission line, which has a seventh current conduction segment and a seventh insulation layer, wherein the seventh insulation layer is configured to coat/cover the seventh current conduction segment. In order to show the third current transmission line 310 and the first current transmission line 306 clearly, the third current transmission line 310 shown in FIG. 3 does not touch the first current transmission line 306 shown in FIG. 3, but the preferred embodiment of the present invention is that the third current transmission line 310 touches the first current transmission line 306; namely, the second insulation layer 3104 touches the first insulation layer 3064. However, if the third current transmission line 310 does not touch the first current transmission line 306, as long as the third current transmission line 310 is near the first current transmission line 306, the effect of the present invention can still be achieved. In order to show the sixth current transmission line 324 and the fourth current transmission line 320 clearly, the sixth current transmission line 324 shown in FIG. 3 does not touch the fourth current transmission line 320 shown in FIG. 3, but the preferred embodiment of the present invention is that the sixth current transmission line 324 touches the fourth current transmission line 320; namely, the fourth insulation layer 3244 touches the third insulation layer 3204. However, if the sixth current transmission line 324 does not touch the fourth current transmission line 320, as long as the sixth current transmission line 324 is near the fourth current transmission line 320, the effect of the present invention can still be achieved. The second current transmission line 308, for example but not limited to, does not touch the first current transmission line 306. The fifth current transmission line 322, for example but not limited to, does not touch the fourth current transmission line 320.

Moreover, the fourth insulation layer 3244 is configured to touch the third insulation layer 3204, so that the second current direction of the second current 328 of the sixth current transmission line 324 is opposite to the first current direction of the first current 326 of the fourth current transmission line 320, so that the second magnetic field generated by the second current 328 of the sixth current transmission line 324 is configured to reduce or countervail the first magnetic field generated by the first current 326 of the fourth current transmission line 320. A second current path of the second current 328 is the first electrical connection part 60, the first current transmission line 306, the first point 302, the first coil 312, the third point 314, the fifth current transmission line 322, the sixth current transmission line 324 and the second electrical connection part 62. A third current path of the first current 326 is the first electrical connection part 60, the fourth current transmission line 320, the fourth point 318, the second coil 316, the second point 304, the second current transmission line 308, the third current transmission line 310 and the second electrical connection part 62.

The advantage of the present invention is to reduce the magnetic field interference generated by the current of the current transmission line outside the coil of the transformer.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A transformer apparatus reducing a magnetic field interference, the transformer apparatus comprising:

an iron core;

a first side coil unit wound around the iron core, the first side coil unit comprising a first point and a second point;

a second side coil unit wound around the iron core;

a first current transmission line connected to the first point;

a second current transmission line connected to the second point; and a third current transmission line connected to the second current transmission line, wherein the first current transmission line comprises:

a first current conduction segment connected to the first point; and a first insulation layer configured to coat the first current conduction segment, wherein the third current transmission line comprises:

a second current conduction segment connected to the second current transmission line; and a second insulation layer configured to coat the second current conduction segment; the second insulation layer configured to touch the first insulation layer.

2. The transformer apparatus in claim 1, wherein the first side coil unit comprises:

a first coil wound around the iron core, the first coil comprising the first point and a third point; and a second coil wound around the iron core, the second coil comprising the second point and a fourth point.

3. The transformer apparatus in claim 2, further comprising:

a fourth current transmission line connected to the fourth point;

a fifth current transmission line connected to the third point; and a sixth current transmission line connected to the fifth current transmission line.

4. The transformer apparatus in claim 3, wherein the fourth current transmission line comprises:

a third current conduction segment connected to the fourth point; and a third insulation layer configured to coat the third current conduction segment.

5. The transformer apparatus in claim 4, wherein the sixth current transmission line comprises:

a fourth current conduction segment connected to the fifth current transmission line; and a fourth insulation layer configured to coat the fourth current conduction segment; the fourth insulation layer configured to touch the third insulation layer.

6. The transformer apparatus in claim 5, further comprising:

an insulation housing, wherein the iron core, the first side coil unit, the second side coil unit, the second current transmission line, the first coil, the second coil and the fifth current transmission line are arranged in the insulation housing.

7. The transformer apparatus in claim 6, further comprising:

a first electrical connection part arranged on the insulation housing; and a second electrical connection part arranged on the insulation housing, wherein the first current transmission line and the fourth current transmission line are arranged in the insulation housing, and are through the insulation housing to be connected to the first electrical connection part; the third current transmission line and the sixth current transmission line are arranged in the insulation housing, and are through the insulation housing to be connected to the second electrical connection part.

8. The transformer apparatus in claim 7, further comprising:

a third electrical connection part arranged on the insulation housing, and electrically connected to the second side coil unit; and a fourth electrical connection part arranged on the insulation housing, and electrically connected to the second side coil unit.

9. The transformer apparatus in claim 8, wherein the first side coil unit is a transformer primary side coil group; the second side coil unit is a transformer secondary side coil group.

10. The transformer apparatus in claim 8, wherein the second side coil unit is a transformer primary side coil group; the first side coil unit is a transformer secondary side coil group.

* * * * *